US006205816B1

(12) United States Patent
Lu

(10) Patent No.: US 6,205,816 B1
(45) Date of Patent: Mar. 27, 2001

(54) TWIN-HEART COMMEMORATIVE COIN

(76) Inventor: Li-Hua Lu, 5F-23, 70, Fu-Shing Road, Taoyuan (TW)

( * ) Notice: Subject to any disclaimer, the term of this patent is extended or adjusted under 35 U.S.C. 154(b) by 0 days.

(21) Appl. No.: 09/316,954

(22) Filed: May 24, 1999

(51) Int. Cl.[7] ..... A44C 13/00

(52) U.S. Cl. ..... 63/1.16; 63/29.1; 63/33; 40/27.5

(58) Field of Search ..... 63/1.11, 1.16, 63/1.17, 20, 23, 26, 28, 29.1, 33; 40/27.5

(56) References Cited

U.S. PATENT DOCUMENTS

| | | | | |
|---|---|---|---|---|
| 993,801 | * | 5/1911 | Simon | 63/29.1 |
| 1,016,706 | * | 2/1912 | Morris | 63/23 |
| 2,506,509 | * | 5/1950 | Kratkowski | 40/734 |
| 2,511,651 | * | 6/1950 | Schlitz | 40/323 |
| 4,215,497 | * | 8/1980 | Levy | 40/649 |
| 4,542,631 | * | 9/1985 | Esser, III | 63/31 |
| 4,912,608 | * | 3/1990 | Lee | 362/104 |
| 5,157,945 | * | 10/1992 | Giehl | 63/33 |
| 5,177,983 | * | 1/1993 | Terada et al. | 63/33 |
| 5,203,183 | * | 4/1993 | Salerno | 63/12 |
| 5,632,164 | * | 5/1997 | Bergagnini | 63/23 |
| 5,676,376 | * | 10/1997 | Valley | 273/288 |
| 5,845,424 | * | 12/1998 | Mitchell | 40/661.06 |

* cited by examiner

*Primary Examiner*—Terry Lee Melius
*Assistant Examiner*—Andrea Chop
(74) *Attorney, Agent, or Firm*—Dougherty & Troxell

(57) ABSTRACT

A twin-heart commemorative coin comprising a coin body with a twin-heart shaped opening at the center, a connecting element with two fixing holes extended from the coin body to the opening. Two heart-shaped components of the same shape and structure, having a recess with a column and a hole at the recess. The two heart-shaped components can be overlapped at the twin-heart opening in a manner that the recesses are aligned with the connecting element so that the respective columns pass through the fixing holes at the connecting element for fitting to the respective holes of the other component to form a twin-heart commemorative coin.

1 Claim, 2 Drawing Sheets

TWIN-HEART COMMEMORATIVE COIN

BACKGROUND OF THE INVENTION

The present invention is related to a commemorative coin, particularly a twin-heart commemorative coin with two heart-like components overlapped in the center of the coin.

Generally the traditional commemorative coin is minted as a one-piece structure, no other component is used to add its value. On the other hand, a coin composed of two different materials means a significant increase in cost of minting.

SUMMARY OF THE INVENTION

The main objective of the present invention is to provide a multiple component type commemorative coin with additional and unique sense of value.

Another objective of the present invention is to provide a commemorative coin with a plurality of metal lusters by using of different metals.

Another objective of the present invention is to provide a twin-heart commemorative coin with two identical heart components. The design of the identical heart components can reduce the cost of tooling for minting the coin, and allows the use of heart components made of different material to provide additional variety of the coin design. For instance, any two heart components can be overlapped in the center of the coin, and the coin can be used as a pendant showing the luster of different metals.

DETAILED DESCRIPTION OF THE INVENTION

Figure 1:
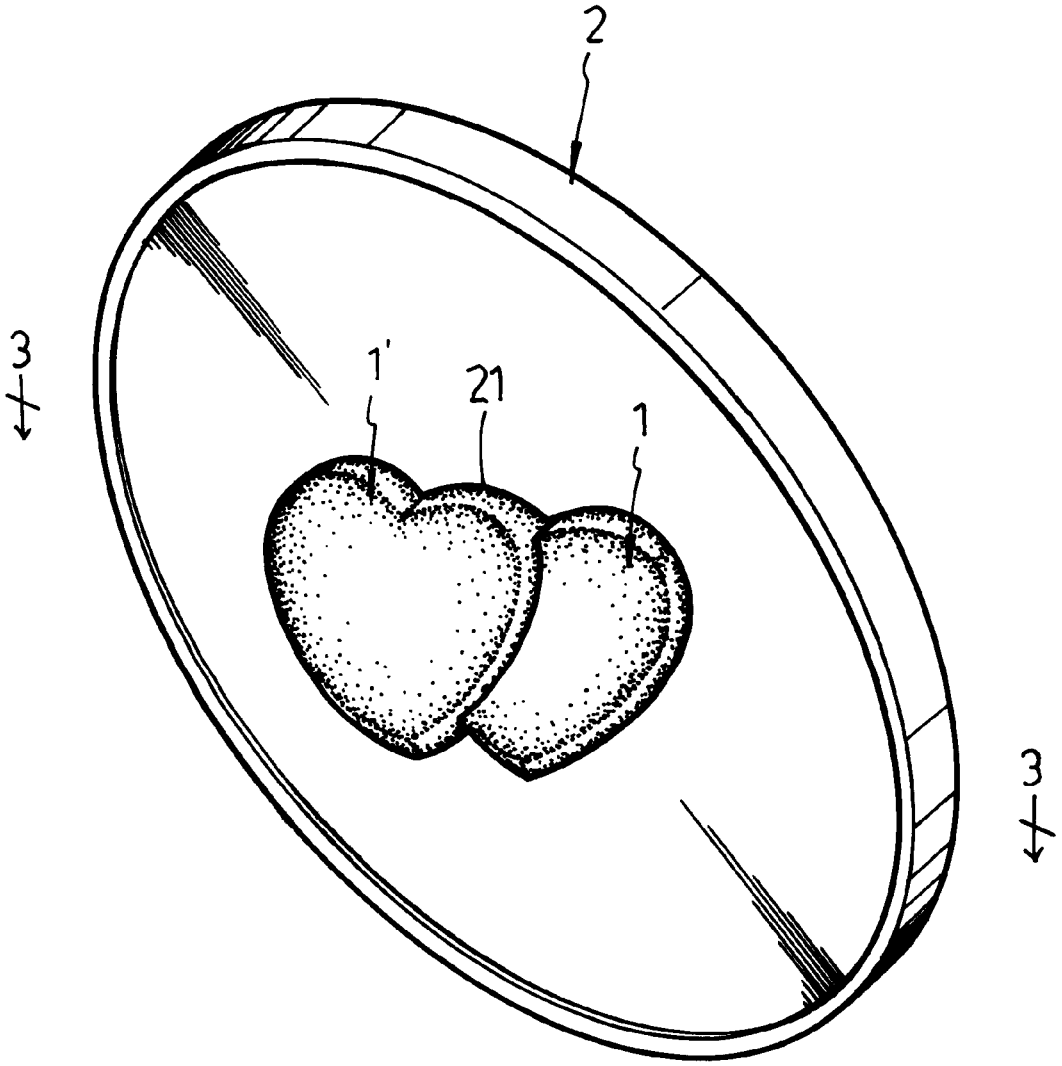
FIG. 1 is a perspective view of an embodiment of the present invention.
Figure 2:
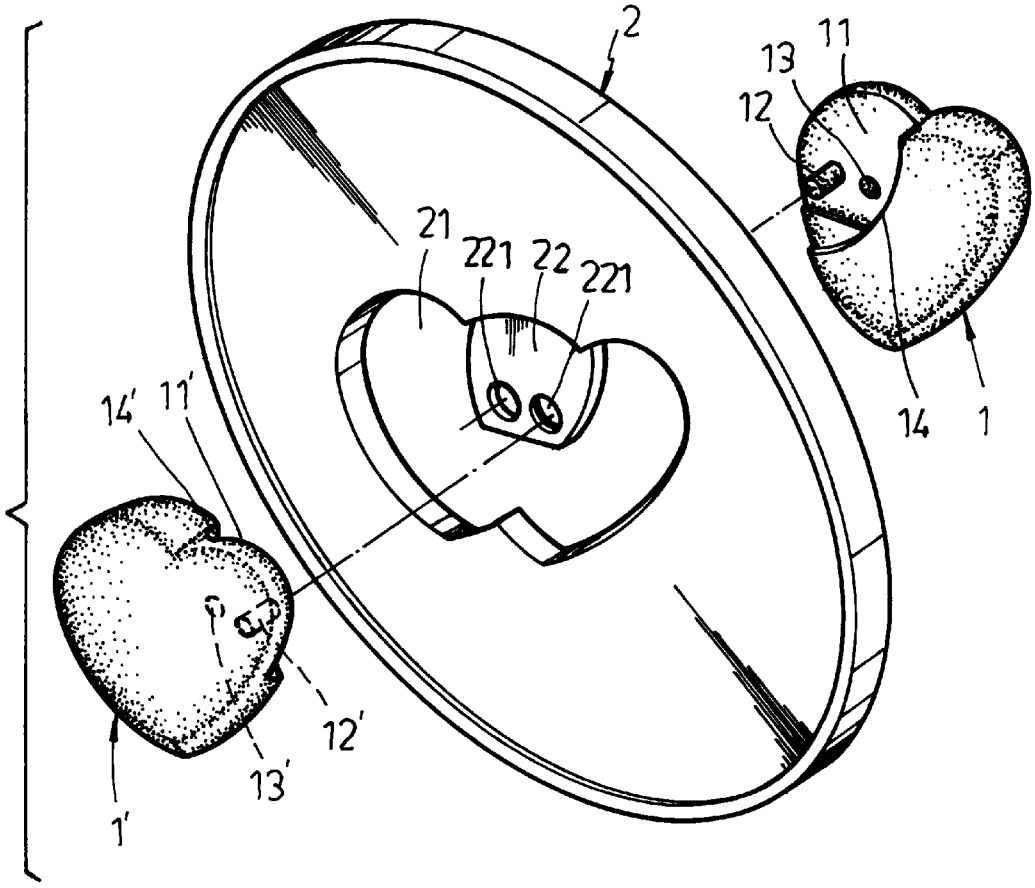
FIG. 2 is a perspective fragmented view of the twin-heart commemorative coin according to the present invention in FIG. 1.

Please refer to FIGS. 1 and 2, the present invention comprises mainly a coin body 2 and two components 1, 1'. Of course, one or more optional components made of different materials can be provided for replacement by the consumer to provide one or more variety in design of the coin.

The coin body 2 is made of metal. Its surface can be embossed with any characters or designs. In the center of the coin body 2 there is a twin-heart shape opening 21 and a connecting element 22 extended from the coin body 2 to the opening 21. The thickness of the connecting element 22 is smaller than the coin thickness, and it is designed with two fixing holes 221.

The components 1, 1' are of a heart-shaped structure. They have an identical structure and they can be fixed to the coin body 2 in any combination. A recess 11, 11' is formed on a side of the component 1, 1'. Each recess 11, 11' has a curved edge 14, 14' corresponding to the shape of the other component 1, 1' in the combination. The curved edge 14, 14' is designed for overlapping of the components to form a twin-heart pattern. In the recess 11,11' a column 12, 12' and a hole 13, 13' are formed.

Figure 3:
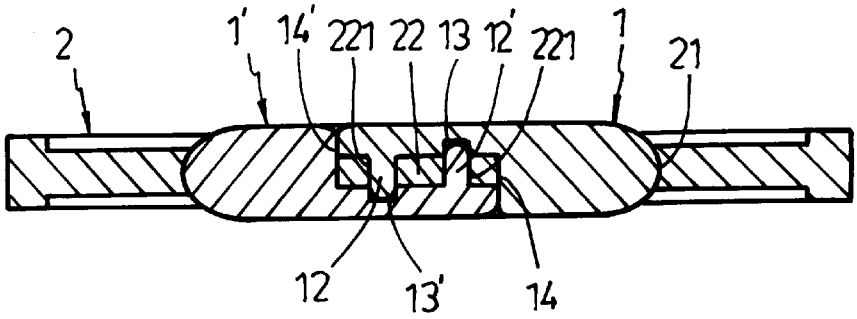
FIG. 3 is a sectional view taken along the line 3—3 in the direction of the arrow in FIG. 1.

Please refer to FIGS. 1 thru 3, upon assembly of the commemorative coin according to the present invention, the two components 1, 1' are placed in the twin-heart hole 21 at the center of the coin body 2 in a manner that the recess 11, 11' are aligned with the connecting element 22 so that the columns 12, 12' pass through the fixing holes 221 at the connecting element 22 for fitting to the respective holes 13, 13' of the other component 1, 1' to form a twin-heart commemorative coin.

What is claimed is:

1. A twin-heart commemorative coin comprising:

a coin body with a twin-heart shaped opening in a center, and a connecting element with two fixing holes extending from the coin body into the opening; and, two heart-shaped components of the same shape and structure, each having a recess at a side, with a column and a hole in the recess, wherein the two heart-shaped components are overlapped in the twin-heart shaped opening, such that the recesses are aligned with the connecting element so that the respective column of each component passes through a respective fixing hole in the connecting element for fitting to the respective hole of each component to form a twin-heart commemorative coin.

* * * * *